166-322 SR
7/1/86 OR 4,597,446

United States Patent [19]

Helderle

[11] Patent Number: 4,597,446

[45] Date of Patent: Jul. 1, 1986

[54] SAFETY VALVES FOR WELLS

[75] Inventor: Paul M. Helderle, Boulogne, France

[73] Assignee: Compagnie Francaise des Petroles, Paris Cedex, France

[21] Appl. No.: 554,731

[22] Filed: Nov. 23, 1983

[30] Foreign Application Priority Data

Nov. 29, 1982 [FR] France ..... 82 19954

[51] Int. Cl.[4] ..... E21B 34/10

[52] U.S. Cl. ..... 166/322; 166/334; 166/217

[58] Field of Search ..... 166/322, 334, 321, 217, 166/375

[56] References Cited

U.S. PATENT DOCUMENTS

| | | | |
|---|---|---|---|
| 3,078,923 | 2/1963 | Tausch | 166/322 |
| 3,517,743 | 6/1970 | Pumpelly et al. | 166/334 X |
| 4,134,455 | 1/1979 | Read | 166/334 |
| 4,161,985 | 7/1979 | Fournier et al. | 166/321 |
| 4,296,807 | 10/1981 | Hendrickson et al. | 166/334 X |
| 4,428,557 | 1/1984 | Yonker et al. | 166/322 X |

*Primary Examiner*—Stephen J. Novosad
*Assistant Examiner*—Michael A. Goodwin
*Attorney, Agent, or Firm*—Sughrue, Mion, Zinn, Macpeak, and Seas

[57] ABSTRACT

A safety valve for installation in a well to close the passage for effluent therefrom comprises a valve body of generally cylindrical shape, shut-off element in a lower part of this body, and a cylindrical slideblock which is slidable longitudinally in the body and adapted to cause, in its descending movement, the opening of the shut-off element. A locking system for locking the valve in the well is located in a radially outer portion of the body and comprises a radially expandable attachment component for engaging, when expanded, in a stop groove provided in the receiving connection of the well surrounding the body. Upper and lower sealing elements for sealing against the receiving connection are arranged on radially outer regions of the body for forming between them a space for receiving a control fluid for the valve, the two sealing elements being arranged longitudinally one on each side of the locking system.

19 Claims, 18 Drawing Figures

SAFETY VALVES FOR WELLS

BACKGROUND OF THE INVENTION

The present invention relates to a safety valve particularly but not exclusively for installation in a receiving connection (called a "nipple") of a production tube of a well, to shut off in this tube the passage of the effluent produced, e.g. oil or gas.

The safety valves used at the present time are provided with a locking system mounted on the upper part of the valve body to lock the latter in a stop groove in the receiving connection of the production tube, and with two sealing linings which are located underneath the locking system and which come up against two inner smooth bearing surfaces of the receiving connection, between which opens an inlet for the fluid for controlling the valve.

The disadvantage of this arrangement is that the safety valves constitute somewhat long components and that they substantially reduce the passage cross-section for the effluent, because their active part is located entirely under the stop groove of the receiving connection, that is to say in a narrowed portion of the latter. This results in considerable load losses. Additionally, the locking system is subjected to the corrosive action of the effluent.

SUMMARY OF THE INVENTION

One object of the invention is therefore to propose a safety valve which can be made of reduced length, which can provide an increased cross-section for the passage of the effluent produced, so that the load losses caused by the presence of the valve and the cost of this valve are reduced. Another object of the invention is to provide a safety valve in which the locking system can be protected from any corrosive action.

According to the invention there is provided a safety valve which comprises a valve body of generally cylindrical shape, shut-off means in the lower part of the body, a cylindrical slide-block longitudinally slidable within said body and adapted to cause, in its descending movement, opening of the shut-off means, locking means located in radially outer portions of said body and comprising a radially expandable attachment component for engaging, when expanded, in a stop groove outside said body, upper and lower sealing means, which are arranged on radially outer portions of said body and which provide between them a space for receiving a control fluid, wherein the two sealing means are arranged longitudinally one on each side of the locking means.

The locking means may therefore be washed by the control fluid, usually hydraulic oil, and the valve may be arranged only partially in the narrower part of the production tube located below the stop groove.

The cylindrical block may be fixed, on the one hand, to a piston which bears in a leak-proof manner against the valve body and is located above the locking means and on which the control fluid acts for causing descent of the cylindrical block, and, on the other hand, to a bearing ring which is likewise located above the locking means and on which acts a restoring spring tending to cause the cylindrical block to rise. This arrangement makes it possible to gain even greater advantage from the installation of the locking means between the two sealing means as regards an increase in cross-section for the passage of the effluent produced.

The restoring spring may be arranged above the upper sealing means in an annular space between the valve body and the cylindrical block, this space being delimited by an upper sealing gasket carried by the valve body and in contact with an upper portion of the cylindrical block and by a lower sealing gasket carried by the valve body and in contact with a lower portion of the cylindrical block along a circumference of greater diameter than that of the contact circumference between the upper gasket and the said upper portion of the cylindrical block, this annular space being intended to be washed by the control fluid.

The attachment component may comprise an elastic ring with an outer profile matching the profile of the stop groove, into which it is to be fitted, and with internal toothing, whilst the valve body incorporates a first recess intended for receiving this attachment component in the unexpanded, and in the not fully active, positions, this first recess being edged at the lower end with a retaining means which is intended to retain the attachment component radially and longitudinally and which is fixed to the valve body, and at the upper end with an expansion means which is located in a second recess of the valve body and is designed to be inserted into the attachment component to complete the expansion of the latter and which is provided with external toothing for engaging with the internal toothing of the attachment component.

The toothings of the attachment component and of the expansion means are preferably left-hand helical threads.

The said second recess may be provided with orifices in its radially inner wall and through which pass keys for the radial retention of the expansion means, the orifices being closed by the cylindrical block against which the keys bear. The cylindrical block may be provided in a lower region with apertures designed to come opposite the said orifices when the cylindrical block is raised into a maximum upper recovery position, which it can reach only after shearing a shearable stop participating in the normal operation of the valve and mounted on the valve body.

In the event that the valve is installed in a receiving connection not designed specially for it, and there is no inner smooth bearing surface above the stop groove in the receiving connection, the upper sealing means may be made of a solid elastic material which, when compressed, bears strongly against the receiving connection of the production tube. Under these circumstances, a spacer tube may be fixed to the valve body by means of a shearable pin in such a position and over such a length that it strikes against the attachment component when the latter is retained in a descending movement of the valve body, and, after the shearing of this pin, it compresses the upper sealing means by bearing on the attachment component.

For an oil well in which the effluent rises because the column of effluent is lightened by means of gas and in which an inner tube is installed within the production tube so as to provide a passage within the inner tube and an annular passage between the inner tube and the production tube, one of these passages serving for injecting lightening gas and the other for the ascent of the lightened effluent, the invention is particularly appropriate because it is then of primary importance to have passage cross-sections which are as large as possible.

In this case, if the safety valve is fastened towards the lower end of the inner tube and if a flap is used as a shut-off means, a coaxial tubular section may be connected to the valve body below the flap, and an intermediate tubular portion, which on the one hand is slidable telescopically and in a leak-proof manner at its upper end on the inner tube, the lower end of which is located at a certain distance above the flap, and which on the other hand is designed to slide telescopically and in a leak-proof manner at its lower end on the said tubular section, is driven in longitudinal displacement by the cylindrical block and has such a length that, depending on the position of the cylindrical block, it can be either located completely above the closed flap or engaged with the said tubular section, the flap then being open.

BRIEF DESCRIPTION OF THE DRAWINGS

Embodiments according to the invention will now be described, by way of example only, with reference to the accompanying drawings.

In the drawings.

DETAILED DESCRIPTION OF THE PREFERRED EMBODIMENTS

Figure 1:
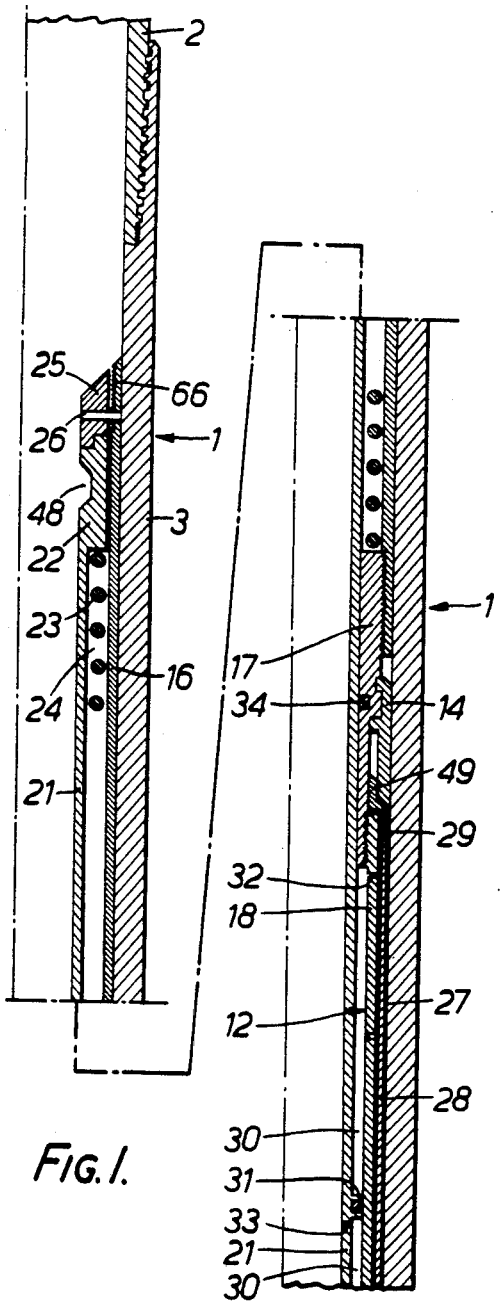
FIGS. 1 and 2 show from top to bottom an embodiment of a safety valve according to the invention installed in a receiving connection of a production tube, in an axial half-section.
Figure 2:
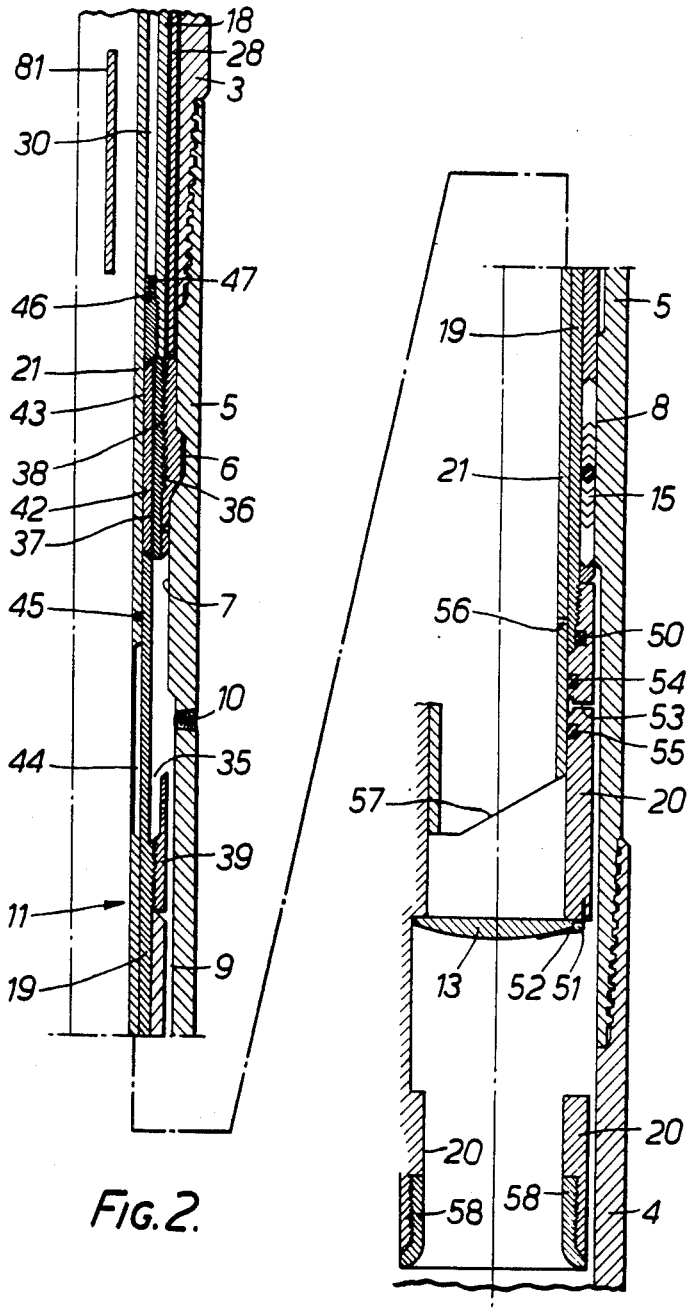

FIGS. 1 and 2 show in half-section a portion of a production tube 1 comprising a series of tubular elements, such as 2, 3, 4, and a receiving connection 5. This production tube 1 is installed in a known way on the inside of an oil well (not shown). The receiving connection 5 comprises an inner stop groove 6 in its upper part and, beneath the stop groove 6, two smooth bearing surfaces, an upper one 7 and a lower one 8, (FIG. 2) which are separated by a recess 9 into which a control fluid, usually hydraulic oil, can be introduced via an orifice 10 provided in the wall of the receiving connection 5.

A safety valve 11 is lowered into the production tube. It comprises a valve body 12, which carries in its lower part shut-off means 13 comprising a flap in the embodiment illustrated in FIG. 2, and two sealing means or linings, an upper sealing lining 14 comprising a solid element made of an elastomeric material, and a lower sealing lining 15 comprising an assembly of V-type packing. The lower sealing lining 15 bears against the lower smooth bearing surface 8 and the upper sealing lining 14 bears against the inner wall of the tubular element 3. The upper smooth bearing surface 7 of the receiving connection 5 is not used, in contrast to conventional installations of safety valves. Of course, it is possible to replace the conventional receiving connection 5 of the production tube 1 with a receiving connection designed specially for a safety valve 11 of the type described here and incorporating an upper smooth bearing surface located above the inner stop groove, thus making it possible to use sealing linings 14 nd 15 whih are both of V-type packing.

The valve body 12 comprises from top to bottom the following portions screwed to one another: an upper radially outer portion 16, a first radially inner intermediate portion 17, a second radially central intermediate portion 18, a radially inner lower portion 19 and a portion 20 for supporting the shut-off means.

A cylindrical block 21 installed within the valve body 12 ends in its upper part in a bearing ring 22, against the lower face of which acts a compression or restoring spring 23, located in the annular space 24 between the cylindrical block 21 and the upper portion 16 of the valve body 12 and supported on the first intermediate portion 17 of this valve body. The normal upper position of the bearing ring 22 and consequently of the cylindrical block 21 is defined by an annular stop 25 retained relative to the upper region of the upper portion 16 of the valve body 12 by means of a shearable pin 26. The first intermediate portion 17 of the valve body 12 serves, on the one hand, as a support for the spring 23 and, on the other hand, as a support for the upper sealing lining 14.

The second intermediate portion 18 of the valve body 12 delimits, together with the tubular element 3 of the production tube 1, an annular space 27 in which is inserted, with a certain transverse play, a spacer tube 28 which is retained by means of a shearable pin 29 on the valve body 12 and the function of which, after the shearing of the pin 29, is to compress the upper sealing lining 14 so as to apply it against the tubular element 3, as will be explained below. This second intermediate portion 18 also delimits, together with the cylindrical block 21, an annular space 30 which is located below the first middle portion 17 of the valve body 12 separating it from the annular space 24 and in which a piston 31 fixed to the annular block 21 can move. This piston 31 separates the annular space 20 in a leak-proof manner into an upper part, which communicates with the orifice 10 by means of a passage 32 provided in the second intermediate portion 18 of the valve body 12, and a lower part in which development of any counter-pressure opposing the displacement of the piston is prevented by the provision of at least one vent 33 in the cylindrical block 21 below the piston 31. The upper part of the annular space 30 constitutes a chamber for moving the cylindrical block 21 downwards. The leak-proofing of this chamber is ensured, on the one hand, by the piston 31 and, on the other hand, by an O-ring type sealing gasket 34 inserted between the first intermediate portion 17 of the valve body 12 and the cylindrical block 21.

Figure 3:
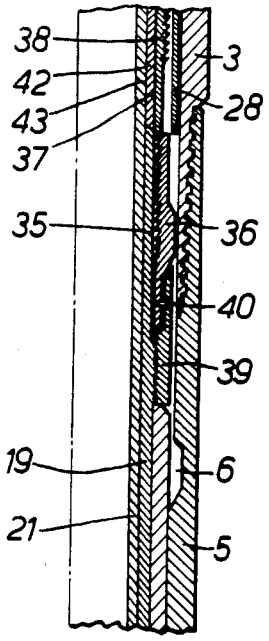
FIG. 3 is a similar view of a portion of the safety valve of FIGS. 1 and 2 and of the receiving connection during the descent of the safety valve in the receiving connection.
Figure 4:
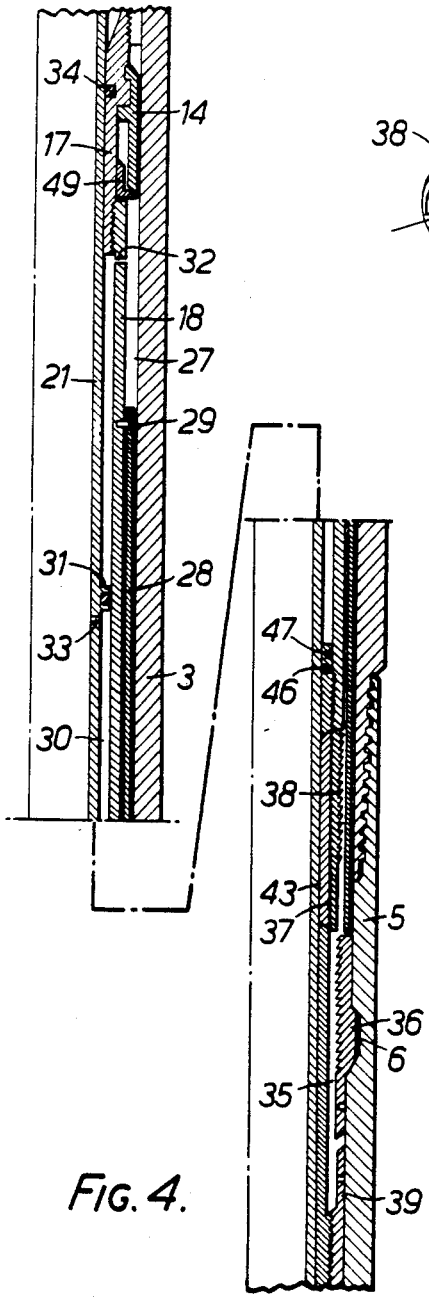
FIG. 4 is a similar partial view of the safety valve of FIGS. 1 and 2 and of the receiving connection at the moment when the attachment component is already engaged in the stop groove, but is not yet locked in it.

The lower portion 19 of the valve body 12 carries, from bottom to top, the lower sealing lining 15, a first recess or receptacle 35 for receiving an attachment component 36 comprising an expandable split ring, and a second recess or receptacle 37 receiving an expansion means 38 for spreading the attachment component 36 apart radially when it penetrates within the component 36. The expansion means 38 has a fixed longitudinal position in the second recess 37, while the expandable ring 36, initially retained longitudinally and radially in the lower part of the first recess 35 by retention means 39 in the form of a ring threaded onto the lower portion 19 of the valve body, to which it is connected by a shearable pin 40, such as a screw (FIG. 3), can, if it is stopped in a descending movement of the safety valve 11 and after the shearing of the pin 40, move longitudinally so as to move into the upper part of the first recess 35 where, freed from the retention means 39, it can resume its natural radially expanded position. The attachment component 36 is, in fact, stopped during the descending movement of the safety valve 11 by the lower edge of the stop groove 6, and as soon as it is freed from the retention means 39 it engages in the stop groove 6, as shown in FIG. 4. When the descending movement of the safety valve 11 continues, the expansion means 38 penetrates within the attachment component 36 and spreads the latter apart even more. The attachment component 36 is thus maintained firmly against the receiving connection 5 in the stop groove 6.

Figure 5:
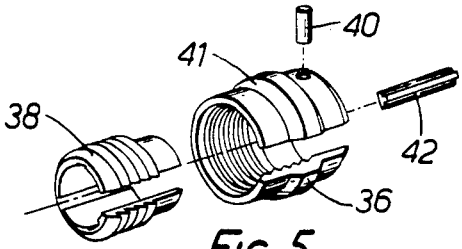
FIG. 5 is an exploded perspective view of the attachment component and of an expansion means for the latter.

FIG. 5 shows in perspective the entire locking system carried by the valve body 12. The attachment component 36, provided with an outer profile 41 corresponding to that of the stop groove 6, has a natural radially expanded position. The expansion means 38 consists of a slightly conical elastic split ring, the natural position of which is a radially retracted position, whilst keys 42, of which there are, for example, three (only one of which has been shown), are arranged within the expansion means 38 so as to keep the expansion means in its radially expanded position. The keys 42 extend into orifices 43 in the base of the second recess 37, the orifices 43 extending through the lower portion 19 of the valve body 12 so that the keys 42 bear against the cylindrical block 21. The expansion means 38 has a left-hand external thread, and the attachment component 36 has on the inside a left-hand thread corresponding to the external thread of the expansion means 38. These two threads are designed to penetrate within one another in order to maintain the attachment component 36 in a longitudinal position relative to the valve body 12. These threads are useful because, as will be seen hereafter, they allow for the possibility of disengagement of the attachment component 36 from the receiving connection 5 by rotation of the valve body 12. The attachment component 36 could alternatively be linked to the expansion means 38 by means of teeth not forming a thread.

The cylindrical block 21 is provided with apertures 44 (FIG. 2) arranged so as to be located below the orifices 43 during the normal operation of the safety valve 11, an O-ring gasket 45 ensuring leak-proofing between the apertures 44 and the orifices 43, just as an O-ring gasket 46 ensures leak-proofing between the annular space 30 and the orifices 43, and an O-ring gasket 47 ensures leak-proofing between the second intermediate portion 18 and the lower portion 19 of the valve body 12. These apertures 44 are likewise arranged so as to be located opposite the orifices 43 when, after the pin 26 has been sheared by pulling on the annular stop 25, the cylindrical block 21 is raised sufficiently to bring it into its maximum upper recovery position, and these operations can be carried out by means of a cable by inserting a gripping tool into an inner groove 48 provided within the bearing ring 22 and also used to lower the safety valve 11 into the receiving connection 5.

It will be seen in FIG. 4 that when the attachment component 36 has penetrated into the stop groove 6, it comes up against the spacer tube 28. The pin 29 retaining this spacer tube 28 is sheared, and the continued descending movement of the valve body 12 causes the upper sealing lining 14 to be compressed by the spacer tube 28 and this sealing lining to be applied in a leak-proof manner against the receiving connection 5. The insertion of an annular wedge 49 makes it easier for the spacer tube 28 to act on the sealing lining 14.

Two advantages of the device which has just been described may be noted here. On the one hand, the hydraulic control oil introduced into the valve 11 via the inlet orifice 10 contributes to applying the upper sealing lining 14 against the receiving connection 5, thus reinforcing the action of the wedge 49. On the other hand, when the safety valve is installed, it is possible to ensure that the anchoring of the latter in the receiving connection 5 has been carried out correctly by introducing fluid under pressure into the valve via the inlet orifice 10 and thus checking that the leak-proofing of the upper sealing lining 14 has in fact been achieved.

The portion 20 supporting the valve body 12 is fastened to the lower portion 19 of the valve body by means of screwing, and this fastening is made leak-proof by means of an O-ring gasket 50. The supporting portion 20 carries a hinge 51 about which the flap 13, biassed to its closed position by a spring 52, can pivot. A pressure-compensating passage 53 has been provided in the lower portion 19 of the valve body between two O-ring gaskets 54 and 55. An orifice 56 provided in the cylindrical block 21 comes opposite the passage 53 when the cylindrical block 21 reaches the flap 13. To make it easier to open the flap, the cylindrical block 21 ends in a bevel 57 so that it first contacts the flap 13 in a region of the latter distant from the hinge 51. Below the flap 13, the supporting portion 20 of the valve body 12 has an inner cylindrical face 58 with a diameter corresponding to the outside diameter of the cylindrical block 21, so that it can receive the cylindrical block in the lower position of the latter.

The mode of operation emerges clearly from the foregoing. During the descent of the safety valve 11 by means of a cable, the attachment component 36 is retained by the lower edge of the stop groove 6, and the pin 40 shears, thus freeing the attachment component 36 which is engaged in the stop groove 6. Then, the spacer tube 28 is retained by the attachment component 36, and the pin 29 shears, thus allowing the spacer tube 28 to start to compress the sealing lining 14. At the same time, the expansion means 38 penetrates into the attachment component 36 and locks it in the stop groove 6. The sealing lining 15 is applied against the bearing surface 8. The valve 11 is then ready to operate. To open it, it is sufficient to supply hydraulic oil via the inlet orifice 10 to the space formed between the valve body 12 and the receiving connection 5 and limited by the sealing linings 14 and 15. This oil passes via the passage 32 into the upper part of the annular space 30 and causes the piston 31 to descend and consequently the cylindrical block 21 to descend. The block 21 in turn brings the orifice 56 opposite the passage 53 so as to equalise the pressures on either side of the flap 13, and then opens the flap. To close the valve 11 again, it is sufficient to relieve the pressure on the control oil supplied to orifice 10, the springs 23 causing the cylindrical block 21 to rise again.

When it is intended to raise the safety valve 11, the bearing ring 22 is pulled by means of a cable, shears the pin 26 and causes the cylindrical block 21 to rise until the piston housing 31 comes up against the first intermediate portion 17 of the valve body 12, thus defining the maximum upper recovery position. The apertures 44 are then located opposite the orifices 43, thus allowing the keys 42 to free the expansion means 38 which resumes its natural radially retracted position and is disengaged from the attachment component 36. The latter is then taken up by the retention means 39 and returns to its retracted position in the first recess 35. At the same time, the keys 42 secure the cylindrical block 21 to the valve body 12. The safety valve 11 is thus disengaged and can be raised to the surface.

It will be noted that the passage within the valve 11 is defined by the cylindrical block 21 which has no inner projecting part and which has few irregularities along its inner surface. This results in minimum load losses for the effluent which thus flows in a virtually smooth pipe.

The valve 11 can easily be matched to different profiles of the stop groove 6. It is sufficient, for this purpose, to change the attachment component 36.

Figure 6:
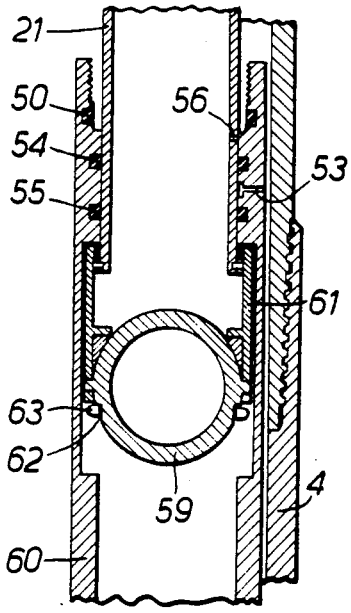
FIG. 6 is an axial section through an alternative form of the shut-off means.

If it is intended to use a shut-off means consisting of a spherical casing 59 (FIG. 6), it is possible to replace the supporting portion 20 of the valve body 12 by a supporting portion 60 carrying a floating seat 61 in which the spherical casing 59 can pivot. The casing 59 is provided with a groove 62 receiving a peg 63 fixed to the portion 60. The cylindrical block 21, when it is displaced vertically, carries along the floating seat 61 and thus causes the spherical casing 59 to pivot in a way known per se, instead of opening a flap 13. In the junction between the cylindrical block 21 and the floating seat, shearable pins are inserted, thus making it possible to raise the cylindrical block 21 when the valve is to be released.

Figure 7:
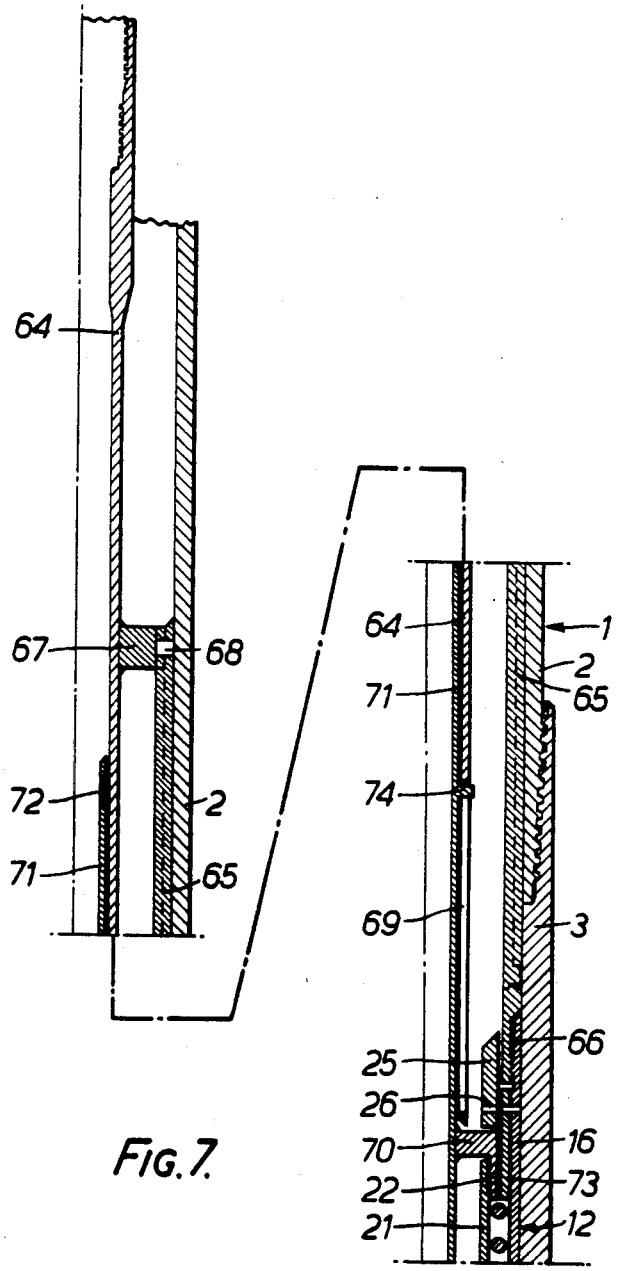
FIGS. 7, 8 and 9 are views similar to those of FIGS. 1 and 2, of another embodiment of safety valve according to the invention designed for receiving an inner tube to lighten the column of effluent by means of gas.
Figure 8:
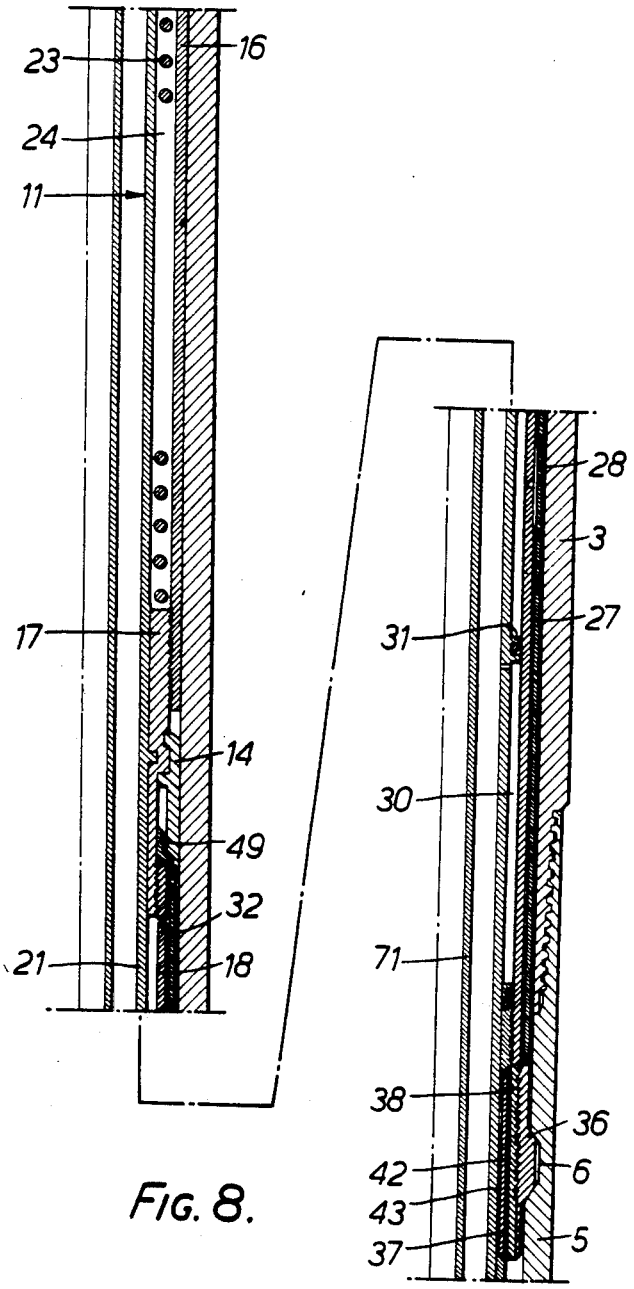
Figure 9:
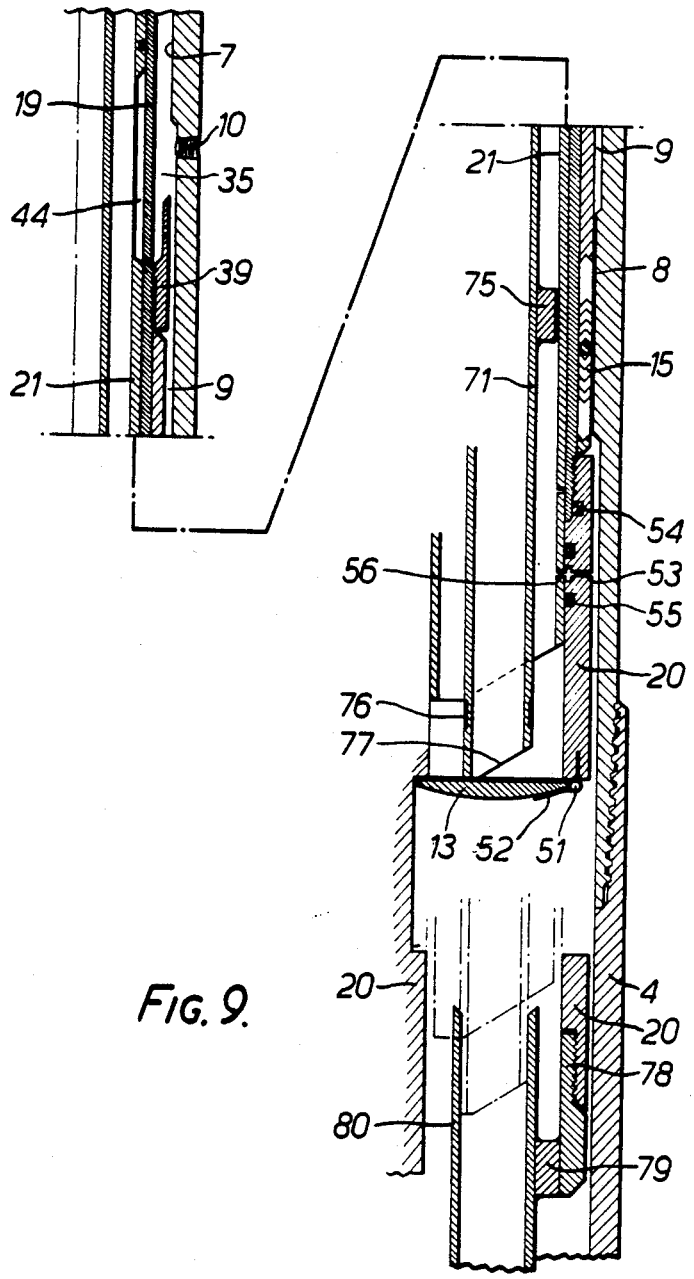

FIGS. 7, 8 and 9 show how the valve illustrated in FIGS. 1 and 2 can be modified so as to be suitable for circumstances in which an inner tube 64 is to be installed within the production tube 1, so as to provide a passage within the inner tube and an annular passage between the inner tube and the production tube, for example for the purpose of lightening the effluent with gas. The following modifications are envisaged.

The upper portion 16 of the valve body 12 is extended upwards by a slide 65 which is screwed at its lower part to a thread 66 provided at the upper part of the portion 16 (this thread can also be seen in FIG. 1 in which it has been provided so as to allow for this adaptation, although it is not used in the embodiment of FIG. 1) and which is connected at its upper part to the inner tube 64 by means of a strut 67. A shearable pin 68 keeps the slide 65 in a closed position. The inner tube 64 ends slightly above the lower face of the annular stop 25 and has in its lower part at least one elongate aperture 69 of a length less than the travel of the slide 65 between its closed and open positions.

The cylindrical block 21 carries, by means of a joining strut 70, an intermediate tubular portion 71 which engages telescopically inside the inner tube 64, to which a leak-proof connection is ensured by means of a gasket 72 moulded from elastomeric material. The bearing ring 22 is modified a little and it is fixed to the joining strut 70 which is connected to the cylindrical block 21 by means of this bearing ring. The annular stop 25 is likewise modified a little, and a centering ring 73 makes the shearing of the pin 26 easier. The intermediate tubular portion 71 carries a peg 74 which engages in the aperture 69 and is adjacent or contacts the upper edge of the aperture 69 when the cylindrical block 21 is in the normal upper position, that is to say when the bearing ring 22 is against the annular stop 25. The intermediate tubular portion 71 carries in its lower part a centering strut 75 which ensures that the intermediate tubular portion 71 is centered in the cylindrical block 21. The intermediate tubular portion 71 carries towards its lower end a gasket 76 moulded from elastomeric material, and it ends in a bevel 77 which is located lower than the lower end of the cylindrical block 21 and which allows the intermediate tubular portion 71 to act on the flap 13 in a region distant from the hinge 51.

The supporting portion 20 of the valve body 12 receives at its lower end an additional portion 78 which carries, by means of a joining strut 79, a coaxial tubular section 80 designed to receive telescopically the lower end of the intermediate tubular portion 71 to which a leak-proof connection is made by means of the moulded gasket 76.

The mode of operation of the safety valve 11 is similar in the embodiment of FIGS. 7, 8 and 9 to that of the embodiment of FIGS. 1 and 2, the only difference being that it is the intermediate tubular portion 71 which opens the flap 13 and that the descending movement of the cylindrical block 21 is prolonged sufficiently to cause the lower end of the intermediate tubular portion 71 to fit into the coaxial tubular section 80.

It will thus be seen that the travel of the piston 31 is different depending on the type of shut-off means 13 or 59 used and depending on whether or not the safety valve 11 is used with an inner tube 64. Consequently, using a standard embodiment of the safety valve 11, the travel is modified by inserting, as and if appropriate, into the lower part of the annular space 30, a floating ring 81 of suitable length, a ring 81 being shown in FIG. 2 without being installed.

The safety valve 11 of FIGS. 7, 8 and 9 is caused to descend by means of the inner tube 64 instead of by means of a cable, but the mode of operation of the locking system and of the system for compressing the upper sealing lining 14 is the same as that described with reference to FIG. 1.

In contrast to this, the method of release and recovery is a little different. There is, first of all, the possibility of releasing the safety valve 11 by rotating the inner tube 64 to the right. This rotation causes, by means of the slide 65 on the one hand and by means of the peg 74 on the other hand, the rotation of the safety valve as a whole, with the exception of the attachment component 36 which normally remains wedged in the stop groove 6. This causes the expansion means 38 to rise and finally disengages it from the attachment component 36 which, no longer being held internally, can be taken up by the retention means 39. At the same time, the upper sealing lining 14 is decompressed.

Instead of this method of releasing the safety valve 11, it is also possible to adopt a method of pulling and ramming upwardly on the inner tube 64. This action first causes the shearing of the pin 68, that is to say half-opening of the slide 65, thus allowing the peg 74 to come up against the lower edge of the aperture 69. By continuing to pull on the inner tube 64, the pin 26 is sheared, thus freeing the annular stop 25 and allowing the cylindrical block 21 to come into its maximum upper recovery position defined when the piston 31 contacts the first middle portion 17 of the valve body 12. The apertures 44 are then located opposite the orifices 43 and the keys 42 (FIG. 5) are freed. This is the same as the process described above. The slide 65 is then completely open and it is this which supports the weight of the safety valve 11 as a whole, the peg 74 having served merely to carry out the releasing operations, but no longer being involved during recovery.

Figure 10:
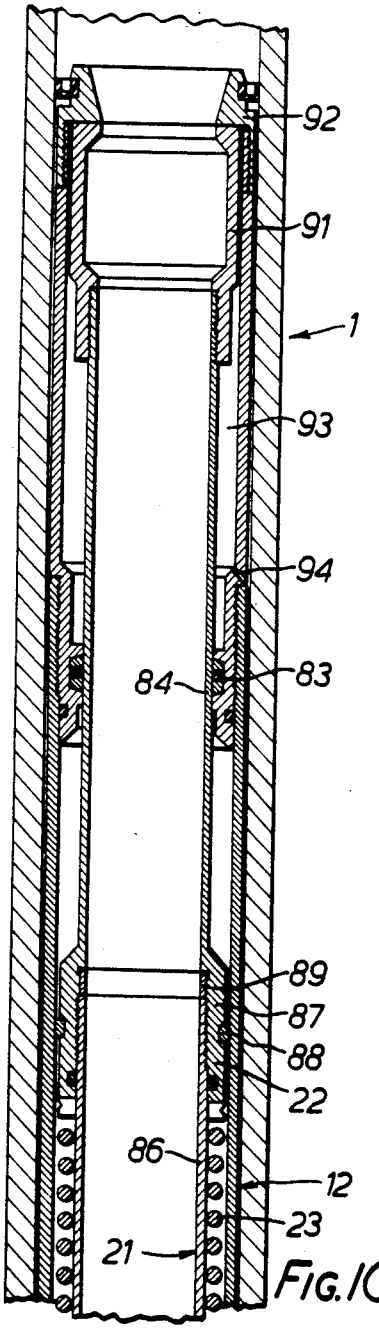
FIGS. 10, 11 and 12 show from top to bottom, in vertical section, a further embodiment of safety valve, according to the invention installed in a receiving connection of a production tube.
Figure 11:
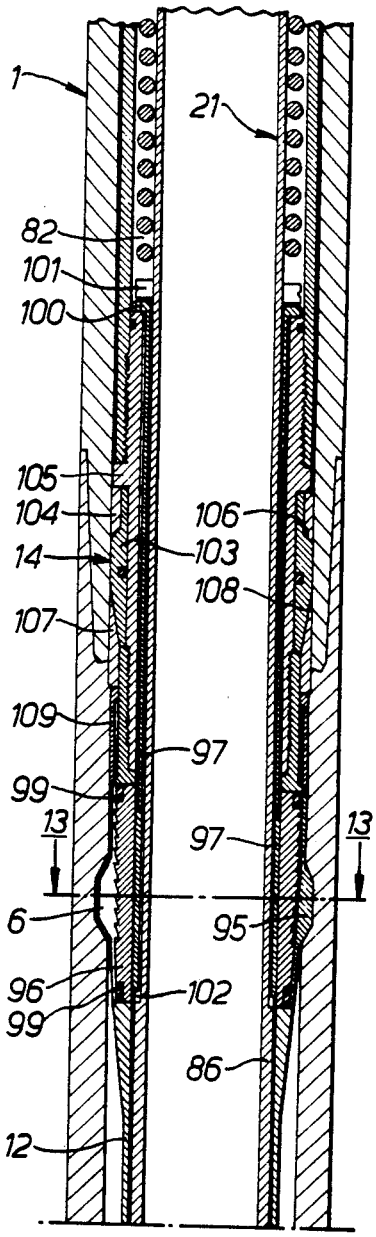
Figure 12:
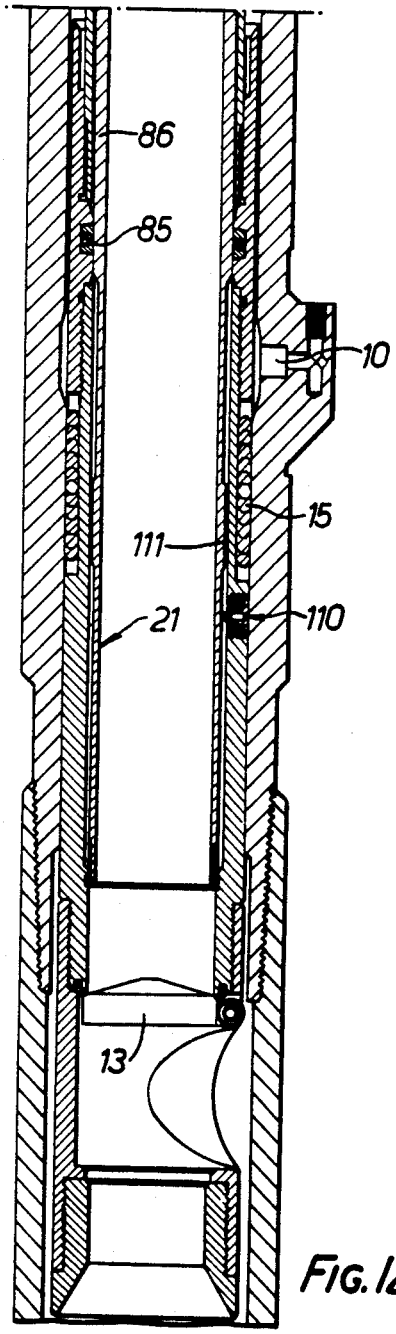

In a preferred alternative embodiment shown in FIGS. 10, 11 and 12, it will be seen that the restoring spring 23 is located in an annular space 82 which is filled with hydraulic oil when the valve is opened. This annular space 82, provided between the valve body 12 and the cylindrical block 21, is delimited by an upper sealing gasket 83 carried by the valve body 12 and being in contact with an upper portion 84 of the cylindrical block 21 along a first circumference, and by a lower sealing gasket 85 also carried by the valve body 12 and being in contact with a lower portion 86 of the block 21 along a second circumference having a diameter greater than that of the first circumference, so as to create a differential surface of action of the hydraulic oil on the block 21. The valve can be adapted for various well depths simply by modifying the diameter of the first circumference.

Figure 17:
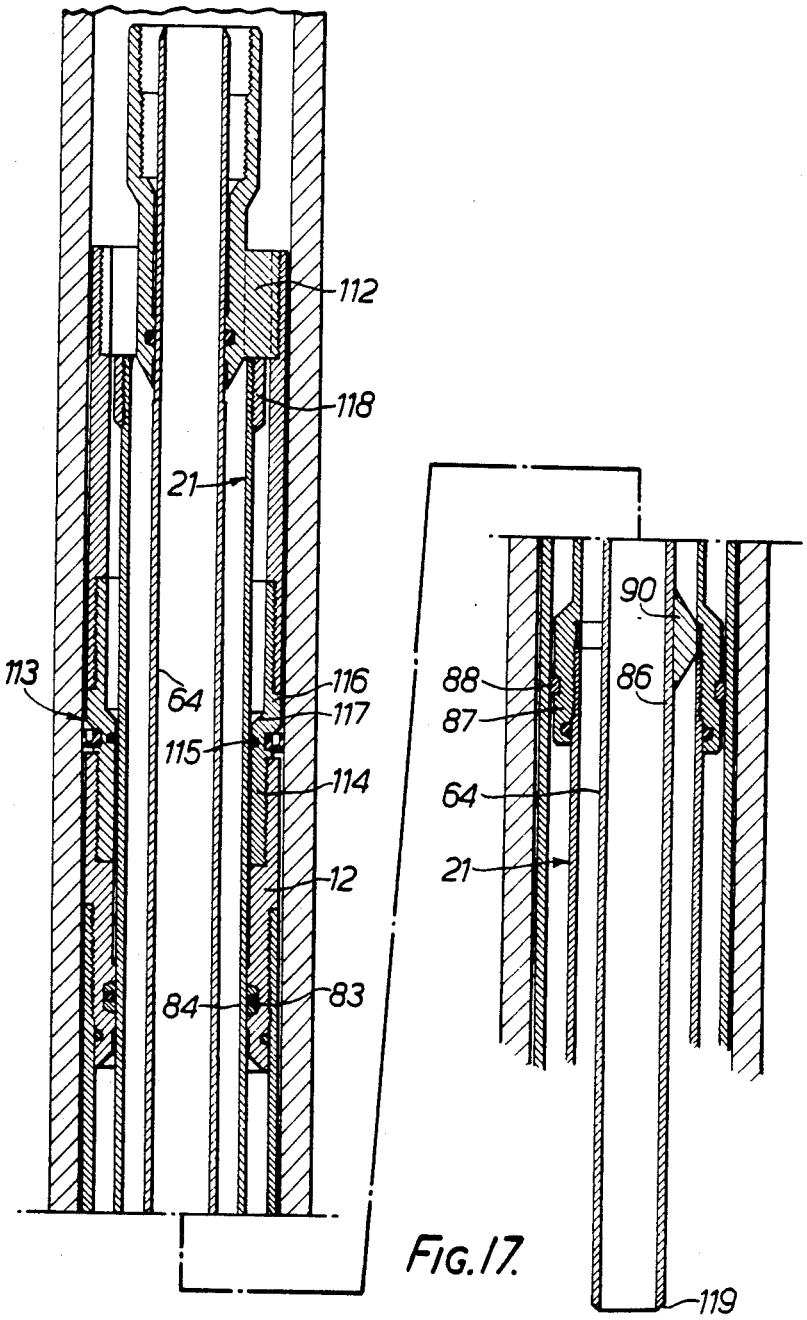
FIG. 17 is a vertical section through the upper part of a further embodiment of a safety valve, with an inner tube fixed to the cylindrical block.

A shock-absorbing system has been provided in the space 82, thus preventing the flap 13 from being subjected to dangerous shocks when it is closed under a high differential pressure. The shock-absorbing system comprises a piston 87 provided with a tetrafluoroethylene ring 88 grooved in a vertical direction to provide throttled passages for the hydraulic oil contained in the space 82. The piston 87, fixed to the block 21, also serves as an upper support for the compression restoring spring 23. In the embodiment illustrated, the piston 87 is formed by a female connection piece carried by the upper portion 84 of the block 21 and connected by means of threading to the lower portion 86 of this block. In this connection piece, a space is occupied by a spacer wedge 89 which, in another embodiment, can be replaced by a strut 90 securing the block 21 to an inner tube 64, as can be seen in FIG. 17.

The upper portion 84 of the block 21 carries a recovery head 91 retained towards its upper end by a shearable stop 92. Between the block 21 and the valve body 12 there is formed, above the upper sealing gasket 83 and below the recovery head 91, a grease chamber 93 provided in its lower part with calibrated orifices 94 making it possible, during the first opening of the valve, to inject a silicone grease into the space between the block 21 and the valve body 12 and thus to prevent any sedimentation, as a result of which the eventual withdrawal of the valve is made much easier.

Figure 13:
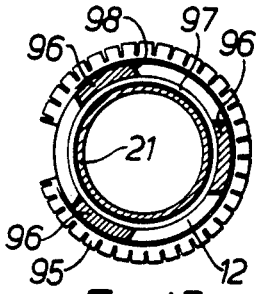
FIG. 13 shows a cross-section along the line 13—13 in FIG. 11.

The locking system comprises an open elastic attachment ring 95 (FIG. 13) provided with internal toothing, spacer keys 96 provided with external toothing and a cylindrical retaining ring 97. The spacer keys 96 are arranged in orifices 98 in the valve body 12 and are retained radially by springs 99 surrounding all the keys.

The cylindrical retaining ring 97 is inserted on the outside round the cylindrical block 21 and spaces the keys 96 radially apart. The ring 97 ends at its upper end in a collar 100 on which the restoring spring 23 bears by means of a washer 101. Thus, any risk of accidental release of the valve in the event of shocks is eliminated.

Figure 14:
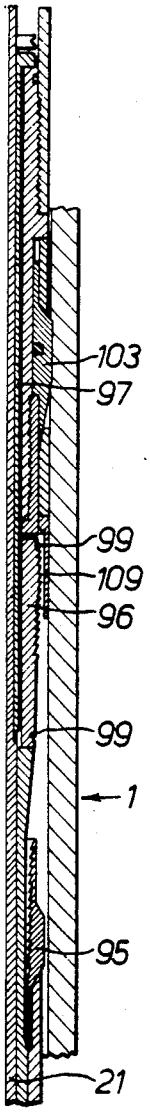
FIG. 14 is a vertical half-section through the locking system and the upper lining of the valve of FIGS. 10 to 12 during the descent of the valve in a production tube.
Figure 15:
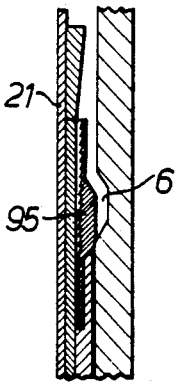
FIG. 15 is a vertical half-section through the locking system of the valve of FIGS. 10 to 12 at the start of the anchoring phase.

The elastic ring 95 is maintained in a low position during the descent of the valve in the production tube 1, as can be seen in FIG. 14. This ring 95 is then retained by the lower edge of the stop groove 6, as shown in FIG. 15, thus allowing displacement of the ring relative to the spacer keys 96 which engage in the ring 95 and keep it radially expanded in the stop groove 6, as can be seen in FIG. 11.

A set-back portion 102 in the outer surface of the block 21 is located below the lower part of the cylindrical retaining ring in the upper position of the block, so that when the valve is to be released the block 21 is pulled upwards, breaking the shearable stop 92, in order to raise the block 21 sufficiently to ensure that the cylindrical retaining ring 97, carried along by this block, disengages from the spacer keys 96 to allow the spacer keys to retract radially into contact with the block 21, thus freeing the elastic ring 95 for radial contraction.

The upper sealing lining 14 comprises a movable component 103 in the shape of a double cone, an upper sealing washer 104 located between a stop 105 carried by the valve body 12 and a conical surface 106 of the component 103, a lower sealing washer 107 located between the other conical surface 108 of the component 103 and a movable compression ring 109. This ring 109 is pushed upwards when the ring 95 engages in the stop groove 6, and it compresses the lower sealing washer 107 directly and the upper sealing washer 104 indirectly. This sytem ensures good leak-proofing between the valve and the production tube, and it is retracted easily without being jammed when the valve is released.

Figure 16:
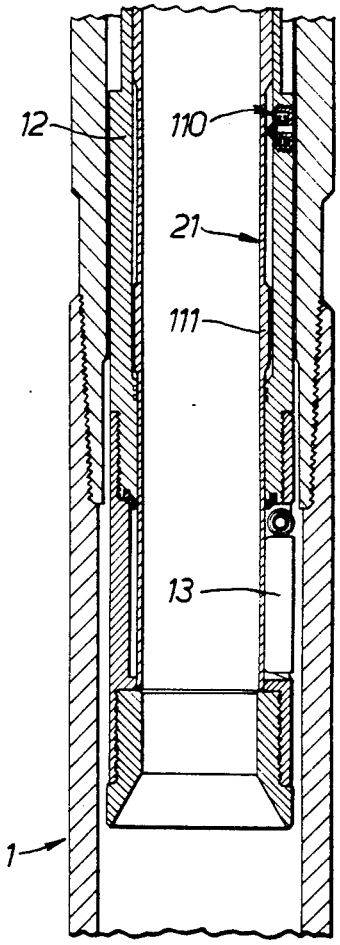
FIG. 16 is a vertical section through the shut-off means in the opening position.

To ensure that the pressures on either side of the flap 13 are equalised, there is located on the valve body 12, below the lower sealing lining 15, a pressure-compensating valve 110 which is normally closed and which is opened, at the moment when the cylindrical block 21 is near the position in which it will open the flap 13, by means of a boss 111 carried by the cylindrical block 21. In FIG. 12, the block 21 is in the upper position and the boss 111 is located above the valve 110. In FIG. 16, the block 21 is in the lower position and the boss 111 is located below the valve 110, having passed the valve 110 when the flap 13 was going to open.

FIG. 17 shows the upper part of an embodiment of a safety valve in which the block 21 is fixed to an inner tube 64. A recovery head 112, through which the inner tube 64 passes, is in its normal state connected to the valve body 12 by means of a connection piece 113, the lower portion 114 of which is screwed to the left in the valve body 12 and an intermediate portion 115 of which has a narrowed cross-section, whilst an upper portion 116 has a shoulder 117 intended to engage an upper ring 118, carried by the block 21 at its upper end, when the connection piece 113 is broken. Thus, the recovery head 112 serves as an upper stop for the block 21 during normal operation and makes it possible to carry the block 21 upwardly, after the connection piece 113 has been broken, either by rotating or by pulling.

Figure 18:
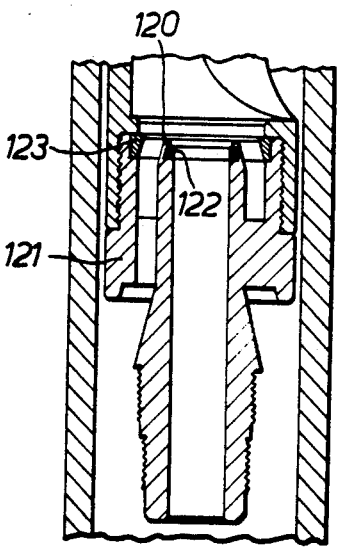
FIG. 18 is a vertical section through the lower suspension receiving the ends of the inner tube and of the cylindrical block in the opening position of the valve.

It will be noted in FIG. 17 that the lower end of the inner tube 64 has been provided with a chamfer 119 which, in the low position of this inner tube, comes up against a metal bearing surface 120 (FIG. 18) of a lower suspension 121 fixed to the valve body. A lip gasket 122 is installed below the metal bearing surface 120. An adjusting wedge 123 makes it possible to compensate in terms of height for the differences between the relative positions of the inner tube 64 and of the block 21.

What is claimed is:

1. A safety valve, comprising; a valve body of generally cylindrical shape and having, in use, an upper end and a lower end, shut-off means near the lower end of said body, a cylindrical block longitudinally slidable within said body and being movable relative to said body to open said shut-off means, locking means located in radially outer portions of said body and comprising a radially expandable attachment component for engaging, when expanded, a stop groove provided outside said body, and upper and lower sealing means arranged in radially outer portions of said body for defining therebetween a space for receiving a control fluid, said upper and lower sealing means being arranged longitudinally one on each side of said locking means, such that said locking means are located in said space for receiving said control fluid.

2. A safety valve according to claim 1, wherein said cylindrical block is fixed to a piston, said piston bearing in a leak-proof manner against said valve body and comprising a surface upon which said control fluid will act to cause movement of said cylindrical block toward said lower end, and said cylindrical block being fixed to a bearing ring, a restoring spring acting on said bearing ring, in a manner tending to move said cylindrical block toward said upper end, said piston and said bearing ring being both located above said locking means.

3. A safety valve according to claim 2, wherein said restoring spring is located in a first annular space formed between said cylindrical block and said valve body, said piston is located in a second annular space formed between said cylindrical block and said valve body, said first annular space is located above said upper sealing means, and said second annular space is located below said upper sealing means, said first and second annular spaces being separated longitudinally by a first intermediate, radially inner portion of said valve body which carries the upper sealing means on its radially outer periphery.

4. A safety valve according to claim 2, wherein said upper sealing means is made of a solid elastic material which is compressable to ensure leak-proofing, and further comprising a spacer tube arranged and fixed to said valve body by means of a shearable pin in a manner such that said spacer tube contacts said attachment component when said attachment component is retained during a descending movement of said valve body and such that, after shearing of said pin, said spacer tube compresses said upper sealing means while bearing on said attachment component.

5. A safety valve according to claim 4, wherein said restoring spring is located in a first annular space formed between said cylindrical block and said valve body, said piston is located in a second annular space formed between said cylindrical block and said valve body, said first annular space is located above said upper sealing means, and said second annular space is located below said upper sealing means, said first and second annular spaces being separated longitudinally by a first, radially inner, intermediate portion of said valve body which carries the upper sealing means on its radially outer periphery, said spacer tube being located in a third annular space concentric with said second annular space and separated radially from said second annular space by a second intermediate portion of said valve body.

6. A safety valve according to claim 1, wherein said attachment component comprises an elastic ring having an outer profile corresponding to the profile of said stop groove and internal toothing, said valve body defining a first recess for receiving said attachment component in its unexpanded state, retaining means at a lower end of said first recess for retaining said attachment component radially and longitudinally, said retaining means being fixed to said valve body, expansion means located in a second recess of said valve body and insertable into said attachment component to expand said attachment component into a fully expanded state, said expansion means being provided with external toothing engagable with said internal toothing of said attachment component.

7. A safety valve according to claim 6, wherein said internal and external toothings comprise left-handed helical threads.

8. A safety valve according to claim 6, wherein said attachment component has a natural expanded state between said unexpanded state and said fully expanded state, and said expansion means comprises an elastic ring having a natural retracted state, and radial-retention keys located within said expansion means to expand said expansion means.

9. A safety valve according to claim 8, wherein a radially inner base of the second recess is provided with orifices into which said keys extend, said keys bearing against said cylindrical block, said cylindrical block being provided with apertures movable to positions opposite said orifices when said cylindrical block is moved maximally upwardly, and a shearable stop mounted on said valve body for preventing said cylindrical block from reaching said maximum upper position during normal operation.

10. A safety valve according to claim 1, wherein said shut-off means comprises a flap mounted below the lower end portion of an inner tube located within a production tube provided with said stop groove, said inner tube and said production tube defining a passage within said inner tube and an annular passage between said inner tube and said production tube, a tubular section connected to said valve body below said shut-off means, and an intermediate tubular portion telescopically slidably mounted in a leakproof manner at an upper end on said inner tube, a lower end of said intermediate tubular portion being located a distance above said shut-off means, and being telescopically slidable in a leak-proof manner into an end of said tubular section, said intermediate tubular portion being fixed longitudinally to said cylindrical block and being movable with said cylindrical block to abut and open said shut-off means and, in a lower position of said cylindrical block, to engage within said tubular section.

11. A safety valve according to claim 10, wherein said valve body is attached to said inner tube by means of a slide movable between a closed position and an open position, said slide being provided with a shearable pin maintaining it in said closed position, said intermediate tubular portion carrying a peg engaged in an elongate aperture in said inner tube so as to be located in the upper part of said elongate aperture in said upper position of the said cylindrical block, the length of said elongate aperture being less than the travel of said slide between its closed position and its open position.

12. A safety valve, comprising; a valve body of generally cylindrical shape and having, in use, an upper end and a lower end, shut-off means near the lower end of said body, a cylindrical block slidable longitudinally within said body for opening said shut-off means, locking means located in radially outer portions of said body and comprising a radially expandable attachment component for engaging, when expanded, a stop groove provided outside said body, and upper and lower sealing means arranged in radially outer portions of said body for defining therebetween a space for receiving a control fluid, said sealing means being arranged longitudinally one on each side of said locking means, said cylindrical block being fixed to a bearing ring, a restoring spring acting on said bearing ring, said spring tending to move said cylindrical block toward said upper end and being arranged above said upper sealing means in an annular space between said valve body and said cylindrical block, said annular space being delimited by an upper sealing gasket carried by said valve body and in contact with an upper portion of said cylindrical block, and by a lower sealing gasket carried by said valve body and in contact with a lower portion of said cylindrical block along a circumference having a diameter greater than that of the circumference of contact between said upper gasket and said upper portion of said cylindrical block, said annular space being connected to a supply of control fluid.

13. A safety valve according to claim 12, further including a shock-absorbing piston having throttled passages, said piston being fixed to said cylindrical block and being located in said annular space and above said restoring spring, so as to damp displacements of said cylindrical block.

14. A safety valve according to claim 12, wherein, when compressed, said restoring spring bears at its lower end on said valve body by means of an upper part of a cylindrical retaining ring located between said cylindrical block and said valve body, so as to maintain said attachment component in a position of radial expansion, a setback portion formed in said cylindrical block being adapted to engage and carry said cylindrical retaining ring when said cylindrical block is moved upwardly.

15. A safety valve according to either claim 1 or claim 12, wherein said attachment component comprises an open ring provided with internal toothing, and further including spacer keys with external toothing located in recesses in said valve body, and being engagable with said attachment component.

16. A safety valve according to either claim 1 or claim 12, wherein said upper sealing means comprises a movable component in the form of a double cone having at least two conical surfaces, an upper sealing washer located between a stop carried by said valve body and one of said two conical surfaces of said movable component, a lower sealing washer located between said other conical surface of said movable component and a movable compression ring, said compression ring being contacted by said attachment component when said attachment component is engaged in said stop groove.

17. A safety valve according to either claim 1 or claim 12, wherein said valve body is provided, below said lower sealing means, with a normally closed pressure-compensating valve, and wherein said lower portion of said cylindrical block carries a boss arranged to open said compensating valve when said cylindrical block is adjacent a position in which it will open said shut-off means.

18. A safety valve according to claim 12, wherein said upper portion of said cylindrical block is provided with a recovery head which together with said valve body forms, above said upper sealing gasket, a grease chamber connected by orifices to the outside of said valve body.

19. A safety valve according to either claim 1 or claim 12, wherein said cylindrical block is fixed to an inner tube which defines a passage within said inner tube and an annular passage outside said inner tube, recovery means attached to said valve body by means of connection means having a shearable portion, said recovery means forming an upper stop for said cylindrical block, said cylindrical block carrying at its upper end an upper ring engagable with said connection means after said shearable portion has been broken.

* * * * *